United States Patent [19]

Flaherty

[11] Patent Number: 4,487,290

[45] Date of Patent: Dec. 11, 1984

[54] LIGHT AIRCRAFT ENGINE MUFFLER

[75] Inventor: William J. Flaherty, Davenport, Iowa

[73] Assignee: Mustang Units Co., Davenport, Iowa

[21] Appl. No.: 490,011

[22] Filed: Apr. 29, 1983

[51] Int. Cl.[3] ..... F01N 1/24

[52] U.S. Cl. ..... 181/256; 181/258; 181/239; 181/273; 181/272; 181/199

[58] Field of Search ..... 181/256, 252, 270, 404, 181/258, 281, 264, 222

[56] References Cited

U.S. PATENT DOCUMENTS

| | | | |
|---|---|---|---|
| 2,705,541 | 4/1955 | Finch | 181/264 |
| 3,710,891 | 1/1973 | Flugger | 181/256 |
| 3,757,892 | 9/1973 | Raudman, Jr. | 181/256 |
| 4,263,982 | 4/1981 | Feuling | 181/256 |

*Primary Examiner*—Michael L. Gellner
*Assistant Examiner*—Brian W. Brown
*Attorney, Agent, or Firm*—Henderson & Sturm

[57] ABSTRACT

A relatively small, lightweight muffler is provided, especially adapted to low horsepower aircraft and comprises an elongated, essentially cylindrical structure made up of inner and outer casings having sound-absorbent-material-containing chambers and pressure-wave trap elements to minimize exhaust noises. The rear end of the muffler is in the form of a cone having its apex to the rear and containing a quantity of sound-absorbent material in a rearward part thereof and the conical wall ahead of this material being perforated. One form of the structure has a convex or hemispherical front end for aerodynamic purposes in those cases where the muffler is installed externally of the aircraft. The pressure-wave traps comprise walled structures having louvered slots therein appropriately aimed to direct the pressure waves to the sound-absorbent material.

11 Claims, 7 Drawing Figures

LIGHT AIRCRAFT ENGINE MUFFLER

BACKGROUND AND SUMMARY OF THE INVENTION

The present invention is devoted especially to utilization in connection with the exhaust of the internal-combustion engine of small, lightweight aircraft, e.g., in the order of 100 to 150 H.P. In aircraft of this type, the occupant does not have the comfort of an enclosed cockpit or insulated cabin, but on the contrary, rides fairly close to the engine and is of course exposed to engine noise, which is quite high in decibels. Although this problem has been long recognized, a satisfactory muffling system has, so far as is known, not been devised, especially systems that can be purchased on the open market as distinguished from hand-crafted mufflers adapted for special circumstances. A further need for a satisfactory muffler in small aircraft environment is demonstrated by the problems related to excessive noise that can affect aircraft and occupant safety. For example, when excessive noise is present, it is difficult for the pilot to detect certain engine malfunctions, such as approaching stall. Moreover, excessive noise is known to create hearing problems and damage in addition to causing other forms of discomfort, fatigue, etc.

In some instances, the muffler can be connected to the exhaust within an engine enclosure. In other types of craft, the muffler is better adapted for disposition outside—particularly below—the fuselage. A typical craft that lends itself to the outside or "belly mounting" of the muffler is the "Glasair", manufactured by Stoddar Hamilton Aircraft Inc., Arlington, WA. The muffler provided according to the present invention is well adapted for such installations because its front or nose end is aerodynamically designed. Further it is essentially a cylindrical structure with few if any radial projections, except for the exhaust inlet on some versions. The inventive muffler is seen as a double-walled tubular structure in which the annular space between inner and outer annular walls or casings contains sound-absorbent material. The wall of the inner tubular element or casing has perforations, preferably louvered or finned slots, effecting a pressure wave trap in which the pressure waves are spread radially into the sound-absorbent material. The rear end of the structure is in the form of a cone having its axis coaxial with the annular walls, with its apex rearwardmost. Intermediate its base and apex, the cone is fitted with a circular partition to provide a rear, conical chamber containing sound-absorben material. The wall of the cone intermediate its junction with the outer cylindrical wall of the main body of the muffler is perforated to enable the escape of exhaust. Other versions of the basic concept provide a forward chamber for sound-absorbent material, other types of diffusers and the like, all of which will become apparent as preferred embodiments of the invention are disclosed herein.

DESCRIPTION OF PREFERRED EMODIMENTS OF THE INVENTION

Figure 1:
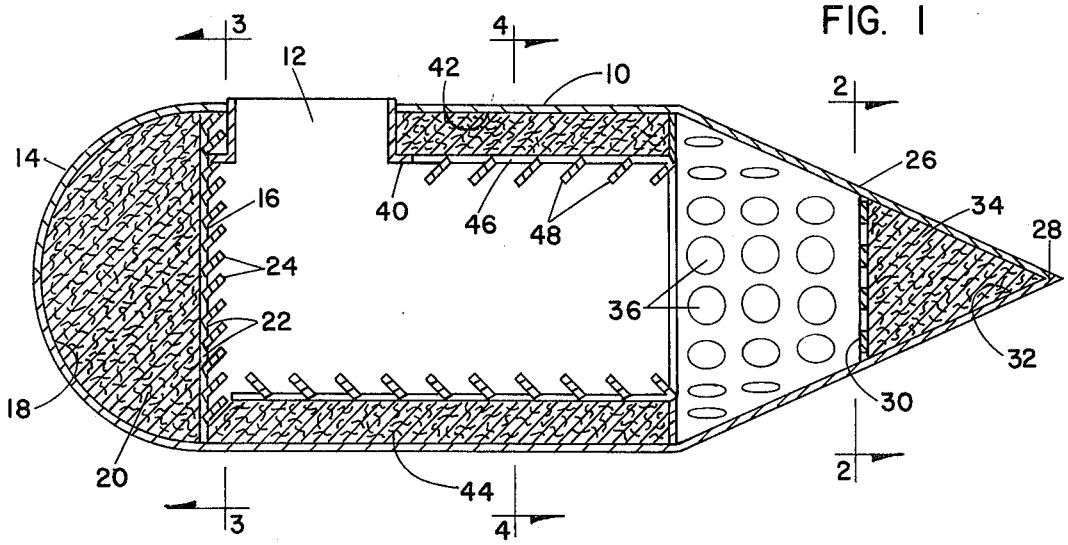
FIG. 1 is a longitudinal section of one form of improved muffler.
Figure 2:
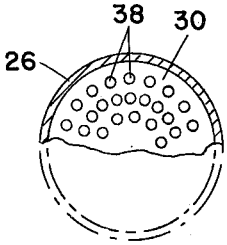
FIG. 2 is a part-section on the line 2—2 of FIG. 1.
Figure 3:
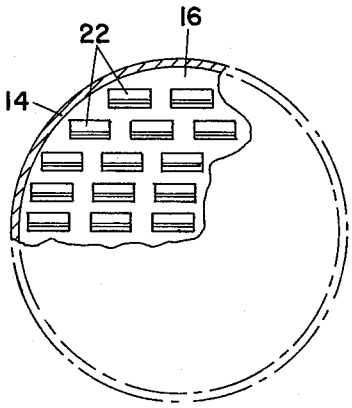
FIG. 3 is a part-section on the line 3—3 of FIG. 1.
Figure 4:
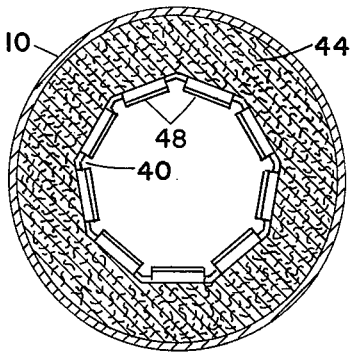
FIG. 4 is a transverse section on the line 4—4 of FIG. 1.

FIGS. 1–4 depict a form of the invention embodying an elongated essentially cylindrical structure having front, or nose, and rear, or tail, ends. This type of muffler is typically adapted for "belly mounting" on the aircraft. The structure is basically double-walled, having an outer cylindrical wall 10 provided with a forwardly disposed, radially directed exhaust inlet 12. The front end of the cylindrical wall is closed by a nose element in the form of a forwardly-convexed (here hemispherical) wall 14 separated from the interior of the cylindrical wall or body by a circular or disc-like partition 16, which occurs at about the junction of the walls 10 and 14, which walls of course are of conventional metal used typically in muffler construction. The nose is therefor of aerodynamic configuration. The partition thus provides a forward or nose chamber 18 which contains suitable sound-absorbent material 20, such as ceramic fibers or the like. The partition is perforated, as by being formed with a plurality of preferably partly-punched-out wall portions which result in slots 22, the remaining portions that are not fully punched out resulting in louvers or fins 24 directed forwardly into the sound-absorbent material 20.

The rear end of the cylindrical wall 10 is fitted with a rear or tail cone 26 having its apex 28 to the rear, the base of the cone being welded or otherwise rigidly secured to the circular rear end of the body or casing 10. A disc or radial partition 30 is disposed intermediate the cone base and apex, thus providing a rear, conical chamber 32 which contains sound-absorbent material 34 like that at 20 at the front end of the structure. That portion of the conical wall intermediate the partition 30 and the rear end of the body casing 10 is foraminous or otherwise provided with holes 36 to enable the escape of exhaust to atmosphere. The partition itself is perforated, having a plurality of openings 38 therethrough to allow exhaust to impinge on the sound-absorbent material 34.

The double-walled nature of the structure is achieved by the use of an interior tubular element 40 coaxial with the cylindrical wall 10 and spacedly surrounded thereby so as to result in an annular chamber 42 extending substantially end-to-end in the structure. This chamber is filled with sound-absorbent material 44 such as that referred to before herein. Because of the nature of the method of providing openings or slots 46, the cross-section of the element 40 appears as multi-sided (FIG. 4) rather than cylindrical, but a cylindrical shape could be utilized at the expense of using another method to form the slots. The method used here is similar to that used in forming the slots in the front partition 16 and results in the formation of fins or louvers 48 in conjunction with the slots. These louvers are arranged so as to direct rearwardly traveling exhaust gases and pressure waves radially outwardly for impingement on the sound-absorbent material 44.

A muffler of the above type, as well as the types to be described below, may have an inlet on the order of one and one-half inches to two and one-half inches in diameter, with an outside casing or wall diameter from three inches upward to four or five inches and a fore-and-aft length of, say, seven to eighteen inches; although, these dimensions may be varied widely and are given as examples of indicating the relatively small size of the structure.

Figure 5:
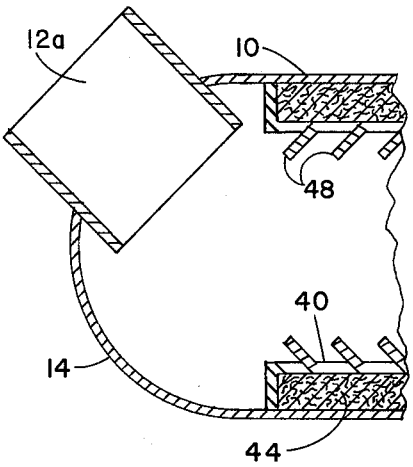
FIG. 5 is a fragmentary section of the fore part of a modified version of the muffler of FIG. 1.

The muffler of FIG. 5 may have all the characteristics of that form just described, including the outer wall 10, tubular slotted and finned element 40, aerodynamic nose 14, but is minus the front partition 16 and has an exhaust inlet 12*a* entering the nose 14 at a downward and rearward angle.

Figure 6:
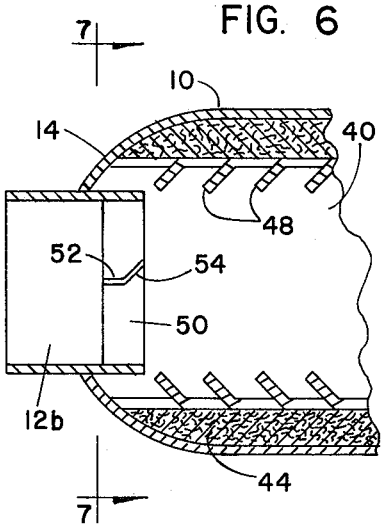
FIG. 6 is a fragmentary section of the fore part of another version of the muffler of FIG. 1.
Figure 7:
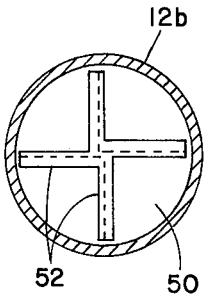
FIG. 7 is a section on the line 7—7 of FIG. 6.

In the muffler of FIGS. 6 and 7, the nose 14 is centrally interrupted to provide for an exhaust inlet 12*b* that is coaxial with and connected to the tubular element 40, the portion of the nose bordering the inlet retaining its aerodynamic shape. Disposed at about the junction of the inlet with the tubular element 40, or upstream of the tubular member louvers 48, is a diffuser 50 in the form of a metal flanged disc having radial slots in it, and each slot has a fin or baffle 54 on the upstream side and these are directed circumferentially in the same direction to further diffuse the entering exhaust.

As will be seen in all forms of the invention, the structure features pressure-wave traps, sound absorbent material and fins, louvers, etc., designed to spread and diffuse the exhaust so as to substantially eliminate, or at least materially reduce noise without creating undesirable back-pressure. With the foregoing embodiments as background, those versed in the art will perceive other modifications and variations, all of which may be achieved without departure from the spirit and scope of the invention.

I claim:

1. A muffler for use with the internal-combustion engine of light aircraft, comprising an elongated, essentially hollow structure having a cylindrical body and front and rear end portions, said body being in the form of an imperforate cylindrical wall, said front end portion including a wall spanning and affixed to the front end of the body, one of said walls including a forward exhaust inlet leading to the interior of the structure, and said rear end portion being in the form of a cone coaxial with and having its base affixed to the rear end of the body and its apex disposed rearwardmost, said cone including a foraminous interior radial partition fixedly positioned intermediate the base and apex of the cone to form a conical chamber at the cone apex, the wall of the cone forwardly of the partition having a plurality of perforations therein, sound-absorbent material contained in the apex chamber, a tubular pressure-wave trap element within the cylindrical wall and extending from the exhaust inlet to the cone, said element having a peripheral wall spacedly surrounded by the cylindrical wall to provide an annular chamber between the element and the cylindrical wall, the element wall including a plurality of slots therein communicating the interior of the element with the annular chamber, and sound-absorbent material contained in the annular chamber.

2. The muffler of claim 1, further characterized in that the front wall is forwardly convex as respects the cylindrical wall.

3. The muffler of claim 1, further characterized in that the front wall is hemispherical.

4. The muffler of claim 1, further characterized in that the front wall is forwardly convex as repects the cylindrical wall and the exhaust inlet is in said front wall.

5. The muffler of claim 1, further characterized in that the front wall is forwardly convex as respects the cylindrical wall and the exhaust inlet is in the cylindrical wall.

6. The muffler of claim 1, further characterized in that the wall of the tubular element has louvers associated with the slots for directing pressure waves from the interior of the element to the annular chamber.

7. The muffler of claim 1, further characterized in that the front wall is forwardly convex as respects the cylindrical wall, the exhaust inlet is in the cylindrical wall, a forward radial partition is fixedly disposed at the junction of the cylindrical and convex walls to provide a forward chamber, said partition having slots opening from the interior of the cylindrical wall to the forward chamber, and sound-absorbent material is contained in the forward chamber.

8. The muffler of claim 7, further characterized in that the partition slots have louvers thereon.

9. The muffler of claim 1, further characterized in that the exhaust inlet is in the front wall and leads coaxially to the tubular element, and a diffuser member is disposed in the inlet upstream of the slots in the tubular element wall.

10. The muffler of claim 9, further characterized in that the diffuser is in the form of a radial wall having substantially radially disposed slots therein.

11. The muffler of claim 10, further characterized in that the radial wall has circumferentially directed deflector fins respectively along the slots and disposed at the downstream side of the diffuser wall.

* * * * *